United States Patent [19]

Whiteman

[11] 4,093,090

[45] June 6, 1978

[54] SPREADER FOR LIFTING CONTAINERS

[75] Inventor: Donald R. Whiteman, Roxboro, N.C.

[73] Assignee: RPC Corporation, Roxboro, N.C.

[21] Appl. No.: 528,167

[22] Filed: Nov. 29, 1974

[51] Int. Cl.[2] ..... B66F 9/14

[52] U.S. Cl. ..... 214/620; 294/67 DA; 294/81 SF

[58] Field of Search ..... 214/620, 621, 730; 294/67 R, 67 BB, 67 DA, 67 DB, 81 R, 81 SF

[56] References Cited

U.S. PATENT DOCUMENTS

| | | | |
|---|---|---|---|
| 2,284,238 | 5/1942 | Todd | 294/67 BB |
| 3,161,309 | 12/1964 | Baudhuin et al. | 294/67 BC X |
| 3,552,557 | 1/1971 | Green | 214/621 |
| 3,589,540 | 6/1971 | Kinross | 214/621 |
| 3,633,777 | 1/1972 | Snelling et al. | 214/621 |
| 3,709,392 | 1/1973 | Kinross | 214/620 |
| 3,713,556 | 1/1973 | Tredray | 214/62 |

*Primary Examiner*—L. J. Paperner
*Attorney, Agent, or Firm*—John H. Mulholland

[57] ABSTRACT

A spreader for lifting containers mountable upon the tines of a fork truck or the like for movement rotatably about a generally vertical axis and horizontally in a direction transversely of the tines. Container engaging devices adjacent the corners of the spreader frame are movable in unison in a direction parallel to the longitudinal tine axes.

14 Claims, 4 Drawing Figures

SPREADER FOR LIFTING CONTAINERS

BACKGROUND OF THE INVENTION

This application pertains to the art of spreaders for lifting containers and, more particularly, to such spreaders which are removably mountable upon the tines of a fork truck or the like.

Spreader frames for lifting containers are commonly mounted on tines of fork trucks or the like. The spreader frame has container engaging devices adjacent the corners thereof for latching onto cooperating latching devices adjacent the four upper corners of the container. Alignment of the container engaging devices on the spreader frame with the cooperating latching devices on the container is very difficult and often requires extensive manipulation of the vehicle by the operator. Once the container has been lifted and transferred to another place, further extensive manipulation of the vehicle is often required for properly aligning the container to stack same in a desired position.

Many arrangements have been proposed for overcoming the alignment difficulty. Prior patents related to such arrangements include Fitch U.S. Pat. No. 2,063,915 who discloses a traveling crane having a generally rectangular frame and pairs of rotatable hoisting drums. One pair of hoisting drums is mounted on a subframe for movement relative to the main frame. Movement of the one subframe places the drums generally at the corners of a rhomboid and this is not suitable for a spreader-type of container lifting device. Meister U.S. Pat. No. 3,176,866 and Levitt U.S. Pat. No. 3,387,730 disclose container lifting devices attached to fork-type of vehicles. A special construction allows transverse movement of the container lifting device relative to the vehicle mast. Green U.S. Pat. No. 3,552,,557 discloses a spreader frame mounted on fork tines for movement rotatably about a generally vertical axis, and horizontally in directions both transversely and longitudinally of the fork tines. While this arrangement includes all of the desired movements for properly aligning the spreader frame with the top of a container, rotatable movement is accomplished by angularly shifting box beams relative to the fork tines. This means that the box beams must be extremely wide in order to accomplish the desired rotational movement and the necessary width of the box beams makes it possible to have transverse misalignment of the base frame relative to the tines so that the load supported on the spreader frame would be unbalanced. In addition, Green connects hydraulic cylinders directly to the horizontal portions of the fork tines and this requires modification of such tines by drilling holes therein. In addition, the spreader is not selfcontained for performing the alignment movements and connection of power cylinders to the fork tines is required. This makes mounting and dismounting of the spreader frame relative to the tines more difficult. Rumell U.S. Pat. No. 3,688,933 discloses a spreader frame mounted on fork tines for movement rotatably, and horizontally in directions both transversely and longitudinally of the tines. There is no provision for power movement of the Rumell spreader frame relative to the tines and this makes it difficult to align such frame. Kinross U.S. Pat. No. 3,709,392 discloses a spreader frame similar to Green and includes a special mounting arrangement for horizontal transverse movement of the frame. Tredray U.S. Pat. No. 3,713,556 is also similar to Green and further includes an arrangement for extending the container engaging devices for placing them at the corners of different size rectangles in order that the spreader frame can be used to lift containers of different sizes.

SUMMARY OF THE INVENTION

A spreader frame having container engaging devices adjacent the corners thereof is mountable on fork tines for movement rotatably, and horizontally in directions both parallel and perpendicular to the longitudinal axes of the tines.

In accordance with an important aspect of the invention, the container engaging devices are movably mounted on the spreader frame for movement in unison relative to such frame in a direction generally parallel to the longitudinal tine axes. The outboard pair of container engaging devices move outwardly beyond the outer periphery of the frame away from the longitudinal axis of such frame, while the inboard pair of container engaging devices move toward such longitudinal axis.

In one arrangement, power means for so moving the container engaging devices relative to the spreader frame comprises a pair of hydraulic cylinders having their axes extending generally parallel to the longitudinal tine axes.

Each pair of container engaging devices at the opposite ends of the spreader frame are connected with one another for movement longitudinally of the tine axes, and the pairs are interconnected for movement in unison.

It is a principal object of the present invention to provide an improved container lifting spreader frame for powered movement relative to fork tines for properly aligning such frame with the top of a container.

Another object of the invention is to provide such a spreader frame which is very simple in operation and economical to manufacture.

An additional object of the invention is to provide such a spreader frame which is capable of all movements without requiring any connection of power means to the fork tines.

BRIEF DESCRIPTION OF THE DRAWING

The invention may take form in certain parts and arrangements of parts, a preferred embodiment of which will be described in detail in this specification and illustrated in the accompanying drawing which forms a part thereof.

DESCRIPTION OF A PREFERRED EMBODIMENT

Figure 1:
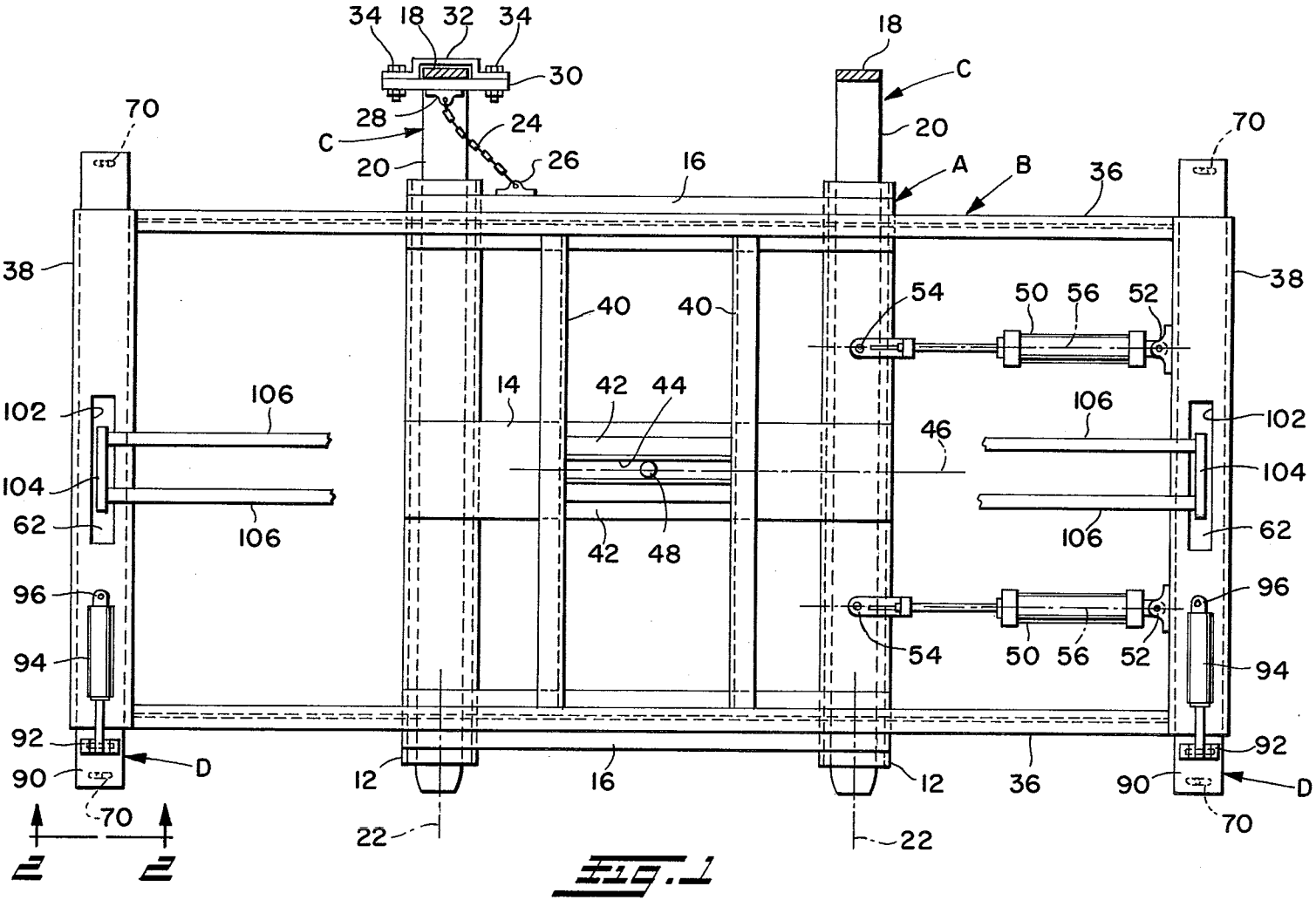
FIG. 1 is a plan view showing a spreader frame constructed in accordance with the present invention.

Referring now to the drawing, wherein the showings are for purposes of illustrating a preferred embodiment of the invention only and not for purposes of limiting same, FIG. 1 shows a container lifting spreader as including a base frame A and a generally rectangular upper frame B movably mounted thereon.

Base frame A includes a pair of parallel spaced-apart hollow box beams 12 having generally rectangular cross-sectional configurations. A central plate 14 and opposite end plates 16 are welded across the tops of box beams 12 to complete the base frame.

Fork tines C are mounted for at least vertical movement on the mast of a fork truck or the like, and include generally vertical portions 18 and generally horizontal portions 20 having longitudinal axes 22 lying in generally parallel spaced-apart horizontal relationship. Such axes 22 also represent the longitudinal axes of box beams 12 in FIG. 1. Horizontal tine portions 20 are receivable completely through box beams 12, and a safety chain 24 may be connected to brackets 26 and 28 on rear end plate 16 and on a securing plate 30 attached to one vertical tine portion 18 by a strap member 32, and bolt and nut assemblies 34. This will prevent accidental displacement of the frame from horizontal tine portions 20.

Each box beam 12 preferably has a width slightly greater than the width of each horizontal tine portion 20 for allowing some lateral shifting movement of base frame A relative to tine portions 20 for achieving final alignment. In addition, the depth of box beams 12 is substantially greater than the thickness of horizontal tine portions 20 for allowing vertical floating movement between horizontal tine portions 20 and base frame A.

Generally rectangular upper frame B includes spaced-apart parallel side frame members 36 having spaced-apart parallel end frame members 38 secured thereto. Spaced-apart central beams 40 are secured between side beams 36, and angle members 42 extending across beams 40 in spaced-apart relationship define a central elongated slot 44 aligned with longitudinal axis 46 of upper frame B. Central plate 14 on base frame A has an upstanding pin 48 welded or otherwise suitably secured thereto and extending upwardly into slot 44.

Double-acting hydraulic cylinders 50 are pivotally connected to one end of each frame member 38 as at 52 and have their rods pivotally connected to one box beam 12 at 54. Such cylinders have longitudinal cylinder axes 56 which lie in spaced-apart parallel relationship equidistantly from and parallel to longitudinal axis 46. Simultaneous operation of double-acting cylinders 50 in the same direction will shift upper frame B horizontally in a direction parallel to its longitudinal axis 46 relative to base frame A. Such movement is also generally perpendicular to longitudinal tine axes 22. Simultaneous operation of double-acting cylinders 50 in opposite directions will rotate upper frame B relative to base frame A about a generally vertical axis corresponding to the axis of pin 48. Slot 44 and pin 48 guide both horizontal transverse and rotational movement of upper frame B relative to base frame A, and also provide retaining means for preventing complete displacement of upper frame B from base frame A. Suitable pads of sintered metal may be positioned between base frame A and upper frame B to facilitate movement of upper frame B relative to base frame A.

Figure 2:
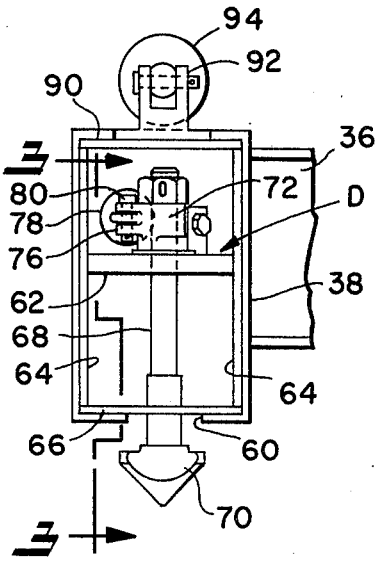
FIG. 2 is an end elevational view looking generally in the direction of arrows 2—2 of FIG. 1.
Figure 4:
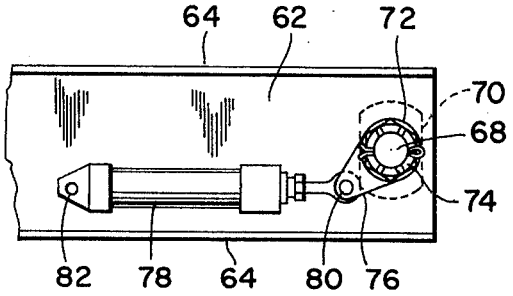
FIG. 4 is a partial plan view looking generally in the direction of arrows 4—4 of FIG. 3.
Figure 3:
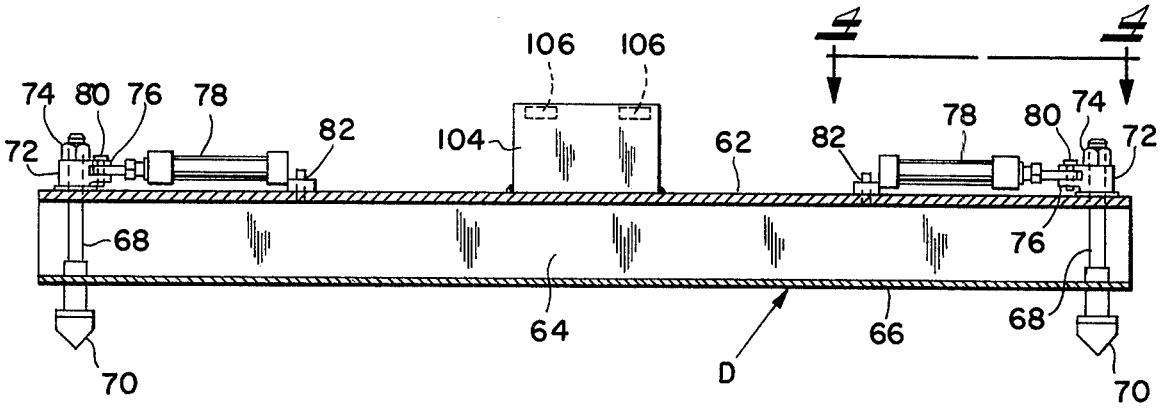
FIG. 3 is a cross-sectional elevational view looking generally in the direction of arrows 3—3 of FIG. 2.

End beam 38 has a generally inverted U-shaped cross-sectional configuration as shown in FIG. 2 and has inwardly extending flange portions to define a longitudinal downwardly facing relatively narrow slot 60, with the inner surfaces of the flanges adjacent such slot serving as slideways. Each beam 38 defines a longitudinal slideway for a connecting beam D which connects or mounts a pair of container engaging devices adjacent each end beam 38. The container engaging devices may comprise conventional twist-lock housings which are interconnected by connecting beam D or other connecting arrangements. In the arrangement shown for purposes of illustration only, beam D may be considered an I-beam positioned on its side with its web 62 extending generally horizontally and its opposite flanges 64 extending generally vertically. A bottom plate 66 may be welded to the bottom edges of flanges 64. Suitable holes are provided in web 62 and plate 66 for receiving shafts 68 of T-shaped locking devices 70. An enlarged bearing member 72 is suitably secured to each shaft 68 above web 62 and a nut 74 is applied to the upper end of shaft 68 above bearing member 72. Bearing member 72 has a radially extending portion 76 defining an eccentric to which the rod of cylinder 78 is pivotally connected as at 80. Cylinder 78 is suitably pivotally connected to web 62 as at 82. The longitudinal axis of each cylinder 78 extends parallel to longitudinal tine axes 22. Once T-shaped locking devices 70 are positioned in suitable elongated openings in the upper portion of a container, cylinders 78 are energized to rotate such locking devices 70 ninety degrees for releaseably securing same with the opening.

A small plate 90 is welded across the top edges of flanges 64 on each beam D adjacent the outboard ends thereof for supporting suitable brackets 92 to which the rod of cylinder 94 is pivotally connected. Each cylinder 94 is also secured or pivotally connected as at 96 to the upper surface of beam 38.

Selective operation of cylinders 94 will move each pair of container engaging devices 70 in unison generally parallel to longitudinal tine axes 22 for achieving a reach adjustment. Beams D simply slide relative to beams 38, and shafts 68 extend through downwardly facing openings 60 in beams 38 for easy reception of T-shaped locking devices 70 in cooperating latching openings on the container.

All of the locking devices may be interconnected to insure movement in unison by any suitable connecting means. In one arrangement, elongated slots 102 are formed in the top of each beam 38 and a suitable plate or brace 104 is welded to each web 62 centrally between the ends of each beam D. Transverse bracing members 106 are secured to bracing plates 104 and completely span beams 38. It will be recognized that it is also possible to provide flow control valves to insure uniform movement of each cylinder 94 in synchronism. Other arrangements may be used such as providing feedback by using a linear voltage differential transformer or the like. Beams D may also be connected adjacent their outboard or inboard end portions if so desired.

During sliding movement of each beam D relative to beam 38, one container engaging device 70 of each opposite end pair moves outwardly away from longitudinal axis 46 of upper frame B, while the other container engaging device in each opposite end pair moves toward such longitudinal axis 46. In the preferred arrangement, outward movement of one container engaging device in each pair takes place outwardly beyond the outer periphery of upper frame B. That is, one container engaging device 70 of each pair will be located completely outwardly beyond the outer surface of one beam 36 and preferably can move outwardly beyond the terminal ends of horizontal tine portions 20. With such an arrangement, it is very easy to position a container very close to another. In previous arrangements, the ends of horizontal fork portion 20 could strike against another stacked container and interfere with positioning of the spreader frame or close stacking of a carried container.

Upper frame B may have outwardly flaring depending guides on its outer periphery adjacent its outer corners, and double-acting cylinders 50 and 94 may be placed in a floating position. Lowering movement of forks C with frame B approximately located in alignment with the top of a container will then allow the guides to shift frame B for properly aligning container engaging devices 70 with the cooperating latches on the container. It will be recognized that it is also possible to provide such depending outwardly flaring guides on beams D for slight final adjusting movement of beams D relative to beams 38.

It will be recognized that the arrangement described provides a completely independent spreader frame which itself contains all of the power means for obtaining the necessary movement to properly align the container engaging devices with cooperating latching devices on the container. Therefore, it is not necessary to make any mechanical connections with fork tines C other than a safety connection as provided by chain 24 or by placing pins through suitable holes in the outer end portion of horizontal tine portions 20. Quick-disconnect couplings may be provided for the conduits connecting the cylinders with the control valves in the vehicle. Converting the fork-type vehicle for use with the container lifting spreader frame and converting back again is greatly facilitated because the spreader frame itself is capable of making all of the necessary movements for achieving alignment without requiring mechanical connection of any hydraulic cylinders to the tines.

In the arrangement shown, container engaging devices 70 which are located closest to tine vertical portions 18 are commonly referred to as the inboard devices, while those devices located adjacent the terminal ends of horizontal tine portions 20 are commonly referred to as the outboard devices. Obviously, suitable rollers or sintered metal bearing pads may be provided between beams D and beams 38 to facilitate sliding movement of such beams D by selective operation of double-acting cylinders 94.

The operator of the vehicle drives the vehicle to a position wherein frame B is approximately aligned with the top of a container to be lifted. Selective operation of double-acting cylinders 50 will then shift upper frame B rotatably about pin 48 or transversely generally perpendicular to tine axes 22, while operation of cylinders 94 will move container engaging devices 70 parallel to tine axes 22 and obtain approximate final alignment. The cylinders may then be placed in a float position and tines C lowered until the guides on frame B or beams D engage the upper periphery of the container for guiding engaging devices 70 into engagement with cooperating latching devices on the container. Operation of double-acting cylinders 78 then rotates locking devices 70 ninety degrees for securing same to the container latching devices. Fork tines C may then be raised and the vehicle operated for conveying the container to another location. When setting the container down in its desired position, all of the cylinders may again be operated as previously described for locating such container in a desired aligned position with other containers.

Having a spreader frame which is capable of all the desired movements independently of any power connections with the fork tines makes it possible to mount such frame on other devices or to suspend same and still have the capability of making final aligning movements.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

I claim:

1. A spreader for lifting containers comprising; base and upper frames, said upper frame being generally rectangular and having a longitudinal axis and being mounted for movement relative to said base frame rotatably about a generally vertical axis and longitudinally generally parallel to said longitudinal axis, power means connected between said frames for so moving said upper frame, a pair of interconnected container engaging devices carried by said upper frame adjacent each opposite end thereof, said container engaging devices in each said pair being spaced-apart along reach axes extending generally perpendicular to said longitudinal axis, each said pair of container engaging devices being mounted for sliding movement in unison in the same direction along said reach axes relative to said upper frame, and power means connected between said upper frame and said container engaging devices for so moving same, said power means for moving said container engaging devices being independent of said power means for moving said upper frame.

2. The spreader of claim 1 and including interconnecting means for interconnecting said pairs of container engaging devices.

3. The spreader of claim 1 wherein said power means for moving said container engaging devices comprises a hydraulic cylinder connected between each said pair and said upper frame and having cylinder axes extending generally parallel to said reach axes.

4. The spreader of claim 1 wherein said container engaging devices are positioned so that during movement of each pair one of such devices in each pair moves away from said upper frame longitudinal axis outwardly of the outer periphery of said upper frame and the other of such devices in each pair moves toward said longitudinal axis.

5. The spreader of claim 1 wherein said base frame includes tine receiving means for mounting said base frame on tines of a fork truck or the like, and said tine receiving means having tine receiving means axes extending generally perpendicular to said upper frame longitudinal axis.

6. In a generally rectangular container lifting spreader frame mountable upon tines of a fork truck or the like and including power means for shifting said frame relative to the tines rotatably about a generally vertical axis and generally horizontally in a direction perpendicular to the longitudinal axes of the tines, said frame having container engaging devices at the corners thereof, the improvement comprising; connecting means for connecting said container engaging devices in pairs at the opposite ends of said frame, each said pair and its associated said connecting means being mounted for sliding movement in unison in the same direction relative to said frame in a direction extending generally parallel to the longitudinal axes of the tines, and power means for so moving said pairs.

7. The spreader of claim 6 wherein said frame includes base and upper frames and said upper frame is movable relative to said base frame rotatably and generally horizontally in a direction perpendicular to the longitudinal axes of the tines, said pairs of container engaging devices being mounted on said upper frame.

8. The spreader of claim 7 and including connecting means for connecting said pairs of container engaging devices.

9. The spreader of claim 7 wherein one of said base and upper frames includes an elongated centrally located slot extending generally perpendicular to the longitudinal axes of the tines, and a pin extending from the other of said frames and being received in said slot.

10. In a generally rectangular container lifting spreader frame having a longitudinal axis and container engaging devices at the corners thereof, the improvement comprising; said container engaging devices being slidably movably mounted on said frame for movement in unison in the same direction generally perpendicular to said longitudinal axis without moving upwardly or downwardly relative to said frame, and power means for so moving said container engaging devices.

11. The spreader of claim 10 wherein said container engaging devices are positioned and mounted so that operation of said power means moves one pair of said devices on one side of said frame away from said longitudinal axis and outwardly beyond the outer periphery of said frame while the other pair of said devices on the other side of said frame move toward said longitudinal axis.

12. The spreader of claim 11 wherein said frame includes mounting means for mounting said frame to tines of a fork truck or the like with said longitudinal axis extending generally perpendicular to the axes of the tines.

13. The spreader of claim 10 wherein said frame has elongated slideways at the opposite ends thereof, said container engaging devices being connected in pairs at opposite ends of said frame, and each of said pairs being slidably mounted on one of said slideways.

14. The spreader of claim 13 wherein said power means comprises a hydraulic cylinder connected between each said pair and said frame.

* * * * *